US007757354B2

(12) United States Patent
Schmitz et al.

(10) Patent No.: US 7,757,354 B2
(45) Date of Patent: Jul. 20, 2010

(54) APPARATUS AT A CARDING MACHINE HAVING A CYLINDER, CARDING ELEMENTS AND DISPLACEABLE HOLDING ELEMENTS

(75) Inventors: Markus Schmitz, Mönchengladbach (DE); Thomas Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 936 days.

(21) Appl. No.: 11/588,260

(22) Filed: Oct. 27, 2006

(65) Prior Publication Data

US 2007/0119029 A1 May 31, 2007

(30) Foreign Application Priority Data

Oct. 28, 2005 (DE) ..... 10 2005 052 142

(51) Int. Cl.
*D01G 15/12* (2006.01)

(52) U.S. Cl. ..... 19/98

(58) Field of Classification Search ..... 19/98, 19/99; 74/99 R

See application file for complete search history.

(56) References Cited

U.S. PATENT DOCUMENTS

| | | | | |
|---|---|---|---|---|
| 3,950,822 | A * | 4/1976 | Bolli | 19/100 |
| 4,384,388 | A | 5/1983 | Mondini | |
| 2006/0168762 | A1* | 8/2006 | Tobben | 19/98 |
| 2006/0168763 | A1* | 8/2006 | Tobben | 19/98 |

FOREIGN PATENT DOCUMENTS

| | | |
|---|---|---|
| DE | 29 48 825 C2 | 12/1980 |
| EP | 0 077 166 A1 | 4/1983 |
| EP | 0 017 357 B1 | 11/1984 |
| EP | 1 231 303 A1 | 8/2002 |
| FR | 2 252 482 | 11/1974 |
| FR | 2 590 326 | 11/1985 |
| FR | 2 850 981 | 2/2004 |
| WO | WO 79/00983 | 11/1979 |

OTHER PUBLICATIONS

French Preliminary Search Report, dated Dec. 6, 2007, issued for corresponding French Application No. 0654577000.
U.K. Search Report.
German Search Report, issued in Application No. 10 2005 052 142.8, dated Apr. 7, 2006.

* cited by examiner

*Primary Examiner*—Shaun R Hurley
(74) *Attorney, Agent, or Firm*—Venable LLP; Robert Kinberg; Leigh D. Thelen

(57) ABSTRACT

In an apparatus at a carding machine having a cylinder, working elements and displaceable holding elements, which determine the carding gap between the cylinder clothing and the working elements, a displacement device actuatable by thermal energy supply is provided for the working elements in order to compensate for changes in the carding gap that arise during operation, and at least one adjusting element cooperates with a fluid. Thermal energy is conveyable to the fluid. In order to keep the carding gap constant or substantially constant in a structurally simple manner, the fluid is expansible by thermal energy supply and the adjusting element is positionally displaceable by expansion and/or contraction of the fluid.

25 Claims, 4 Drawing Sheets

APPARATUS AT A CARDING MACHINE HAVING A CYLINDER, CARDING ELEMENTS AND DISPLACEABLE HOLDING ELEMENTS

CROSS REFERENCE TO RELATED APPLICATION

The present application claims priority from German Patent Application No. 10 2005 052 142.8, dated Oct. 28, 2005, the entire disclosure of which is incorporated herein by reference.

BACKGROUND TO THE INVENTION

The invention relates to an apparatus at a carding machine having a cylinder, carding elements and displaceable holding elements, which determine the carding spacing between the cylinder clothing and the clothings of the carding elements.

The effective spacing of the tips of a clothing from a machine element lying opposite to the clothing is called the carding gap. The last-mentioned element may also have a clothing but could, instead of that, be formed by a segment of a circuit having a conductive face. The carding gap determines the carding quality. The size (width) of the carding gap is an important machine parameter that shapes both the technology (fibre processing) and the running behaviour of the machine. The carding gap is set as narrow as possible (it is measured in tenths of a millimetre) without the risk of a "collision" of the working elements being incurred. In order to ensure uniform processing of the fibres, the gap needs to be as identical as possible over the whole of the working width of the machine.

The carding gap is affected especially by the machine settings on the one hand and by the condition of the clothing on the other hand. The most important carding gap of the revolving card top carding machine is located in the main carding zone, that is to say between the cylinder and the revolving card top assembly. At least one clothing, which limits the working spacing, is in motion, usually both. In order to increase the production rate of the carding machine, it is sought to select an operating rotational speed, or an operating speed of the moving parts, that is as high as the fibre processing technology allows. The working spacing changes in dependence on the operating conditions. The change occurs in the radial direction (starting from the rotational axis) of the cylinder. The carding gap changes during operation especially as a result of thermal expansion and centrifugal force expansion of the cylinder.

During carding, increasingly large amounts of fibre material are processed per unit of time, which requires higher working component speeds and higher installed outputs. The increasing throughput of fibre material (production rate), even when the working surface area remains constant, results in increased generation of heat as a result of the mechanical work. At the same time, however, the technological carding result (sliver uniformity, degree of cleaning, nep reduction etc.) is constantly being improved, which requires a greater number of effective surfaces in carding engagement and narrower settings of those effective surfaces with respect to the cylinder (tambour). The proportion of synthetic fibres being processed, which—compared with cotton—generate more heat as a result of friction when in contact with the effective surfaces of the machine, is continually increasing. The working components of high-performance carding machines are nowadays totally enclosed on all sides in order to conform to the high safety standards, to prevent the emission of particles into the spinning room environment and to minimise the need for servicing of the machines. Grids or even open, material-guiding surfaces allowing exchange of air are a thing of the past. The said circumstances markedly increase the input of heat into the machine, while the discharge of heat by means of convection is markedly reduced. The resulting more intense heating of high-performance carding machines leads to greater thermoelastic deformation which, on account of the non-uniform distribution of the temperature field, affects the set spacings of the effective surfaces: the gaps between cylinder and card top, doffer, fixed card tops and take-off stations with blades are reduced. In an extreme case, the set gap between the effective surfaces can be completely consumed by thermal expansion, so that components moving relative to one another collide, resulting in considerable damage to the affected high-performance carding machine. Accordingly, particularly the generation of heat in the working region of the carding machine can lead to different degrees of thermal expansion when the temperature differences between the components are too great.

In order to reduce or avoid the risk of collisions, the carding gap between clothings lying opposite to one another is in practice set relatively wide, that is to say a certain safety spacing exists, but a large carding gap results in undesired nep formation in the card sliver. On the other hand, an optimum, especially narrow, dimension, by means of which the proportion of nep in the card sliver is appreciably reduced, is desirable.

In a known apparatus (DE 29 48 825 C), a displacement device actuatable by thermal energy supply is provided for compensating for changes in the carding spacing that arise during operation, at least one adjusting element, for example a rod, cooperating with a fluid, for example oil, and the thermal energy being conveyable to the fluid. For the purpose of effecting the supply of heat by means of a fluid, a protective cover is connected to a fluid supply line and to a fluid discharge line, which open into a container for the fluid. Installed in the fluid supply line is a pump by means of which the fluid can be fed under pressure from the container into the chamber formed round the metal rod by the protective cover. Using a heating device (for example an electrical resistance heating device), the fluid is so heated in the container, to a particular temperature determined by a control means, that the rod is able to expand to a greater or lesser degree. The adjusting devices may comprise a liquid (water, oil) or a gas (for example air), and can effect positioning of the guide bend (flexible bend) on which the ends of the clothed flats slide. In that apparatus, heat thus acts on the liquid, the liquid transfers the heat to a stationary metal rod and the metal rod rotates as a result, the position of the flats, and hence the carding space, being changed by way of the guide bends. A disadvantage is that the heating of metals, both ferrous and non-ferrous, reduces the modulus of elasticity, for example by 20%. Given that the adjusting element is in a resiliently pre-biased state on account of the pre-biasing of the guide bend, additionally compensation for that difference is required, which is of considerable expense in terms of apparatus. A further problem is that a metal rod of a particular length, for example 150 mm, requires a high energy supply, for example heating by about 300°K, to achieve an expansion of, for example, 0.3 mm.

It is an aim of the invention to provide an apparatus of the type described at the outset that avoids or mitigates the mentioned disadvantages and that especially makes it possible, in a structurally simple manner, to keep the carding gap constant or substantially constant.

SUMMARY OF THE INVENTION

The invention provides an apparatus at a carding machine having a cylinder with cylinder clothing, working elements, and displaceable holding elements which determine an adjustable space between the cylinder clothing and one or more of the working elements, further comprising:

a displacement device comprising at least one adjusting element for adjusting the position of one or more said displaceable holding elements to compensate for changes in the spacing during operation; and a fluid that is expansible by thermal energy supply and contractible by thermal energy discharge;

wherein said at least one adjusting element is displaceable by expansion and/or by contraction of the fluid.

The position of the carding elements and thus the size of the carding gap are changed in simple manner because the heat supply brings about positional displacement of the adjusting element, for example rod, by way of thermal expansion of the fluid, for example oil. A particular advantage is that use is made of the expansion of a liquid medium that has a thermal coefficient of expansion higher by a factor of, for example, 100 than that of solids. As a result, in contrast to the known apparatus, a change in temperature of, for example, only 20° K is required to achieve a displacement of about 0.3 mm. A further advantage is that that temperature change is at the components of the carding machine. In that way it is possible to utilise the required thermal energy directly from the components, as a result of which automatic adjustment is effected in the event of changes in temperature of the machine or in the event of changes in the carding gap caused by temperature. Preference is given to the use of a fluid medium that in terms of expansion is correlated with the change in temperature in the carding machine and/or at components of the carding machine. The changes in the carding gap caused by temperature are compensated by that medium.

Advantageously, the fluid is a liquid, which is preferably a non-compressible liquid. Advantageously, the fluid is an oil, especially a hydraulic oil. Advantageously, the coefficient of thermal expansion of the fluid is high, preferably at least $$7 \cdot 10^{-5} \frac{1}{°K.},$$

for example, approximately $$\alpha = 7 \cdot 10^{-4} \frac{1}{°K.}.$$

Advantageously, the change in the carding gap is at least 0.05 mm per 10° K increase in temperature, for example, approximately 0.1 mm per 10° K increase in temperature. Advantageously, the adjusting element comprises a metal rod, a bar or the like. Preferably, the adjusting element comprises a cylinder piston. Advantageously, the displacement device comprises a container, a housing or the like. Advantageously, the adjusting element is attached by one end to the cylinder. Advantageously, the cylinder piston and the region of the adjusting element facing the cylinder piston are arranged in the container, housing or the like. Advantageously, the region of the adjusting element remote from the cylinder piston is arranged outside the container, housing or the like or projects from the container, housing or the like. Advantageously, the fluid is present between the inner wall of the container, housing or the like and at least one end face of the piston. Advantageously, the fluid is present between the inner wall of the container, housing or the like and an end face of the piston. Advantageously, the adjusting element, for example rod, bar or the like, is force-loaded. Advantageously, the adjusting element, for example rod, bar or the like, is spring-loaded, for example, by a compression spring. The spring may be arranged between an end face of the piston and the opposite lying inner wall of the container, housing or the like. Preferably, the container, housing or the like is sealed. Advantageously, the fluid is located in a sealed interior space of the container, housing or the like. Advantageously, the portion of the adjusting element projecting from the container, housing or the like is connected to the carding element. Advantageously, the carding element is locally displaceable together with the adjusting element. Advantageously, the displacement is effected in radial direction in relation to the cylinder. The displacement device may be mounted between the extension bend and a working element, for example carding element. The rod, bar or the like may have an adjusting thread. The displacement device may be mounted between an adjusting spindle (threaded spindle) and a working element. The displacement device may be mounted between an adjusting spindle (threaded spindle) and a flexible bend.

Advantageously, the fluid is in communication with the machine via a heat conduction means or the like. For example, the fluid may be acted upon by the heat of an extension bend; by the heat of a cover element, for example a cover element for the cylinder or a cover element located in the angled gap between two cooperating rollers; or by the heat of a side panel.

There may instead be associated with the displacement device a heating device. The temperature of the heating device is advantageously adjustable. The heating device may be associated with the rod, bar or the like, for example the piston. The heating device may be associated with the fluid or the region of the container, housing or the like enclosing the fluid. Advantageously, the return of the adjusting element (displacement path) is effected by energy discharge from the fluid. The return of the adjusting element (displacement path) may instead be effected by a card flat setting system, for example PFS, or by a card flat measuring system, e.g. FCT.

The working elements may be carding elements, the spacing to be adjusted advantageously being the carding gap between the cylinder clothing and the clothings of the carding elements. The working elements may be clothed rollers, for example lickers-in and/or doffers, the spacing between the clothings of the cooperating rollers, for example cylinder, lickers-in and/or doffers, advantageously being changeable. The working elements may be separator blades for trash or the like.

The invention also provides an apparatus at a carding machine having a cylinder, working elements and displaceable holding elements, which determine the spacing between the cylinder clothing and the working elements, wherein a displacement device actuatable by thermal energy supply is provided for the working elements in order to compensate for changes in the spacing that arise during operation and in which at least one adjusting element, for example a rod, cooperates with a fluid, for example oil, and the thermal energy is conveyable to the fluid, wherein the fluid is expansible by thermal energy supply and/or contractible by thermal energy discharge and the adjusting element is locally displaceable by expansion and/or contraction of the fluid.

The invention also provides a method of adjusting a working gap in a carding machine, comprising providing an adjusting element for positionally displacing a working element defining a limit of said working gap, providing a fluid that is thermally expansible and contractible, and utilising thermal expansion and/or contraction of said fluid for acting on said adjusting element for effecting positional displacement of said working element.

DETAILED DESCRIPTION OF CERTAIN PREFERRED EMBODIMENTS

Figure 1:
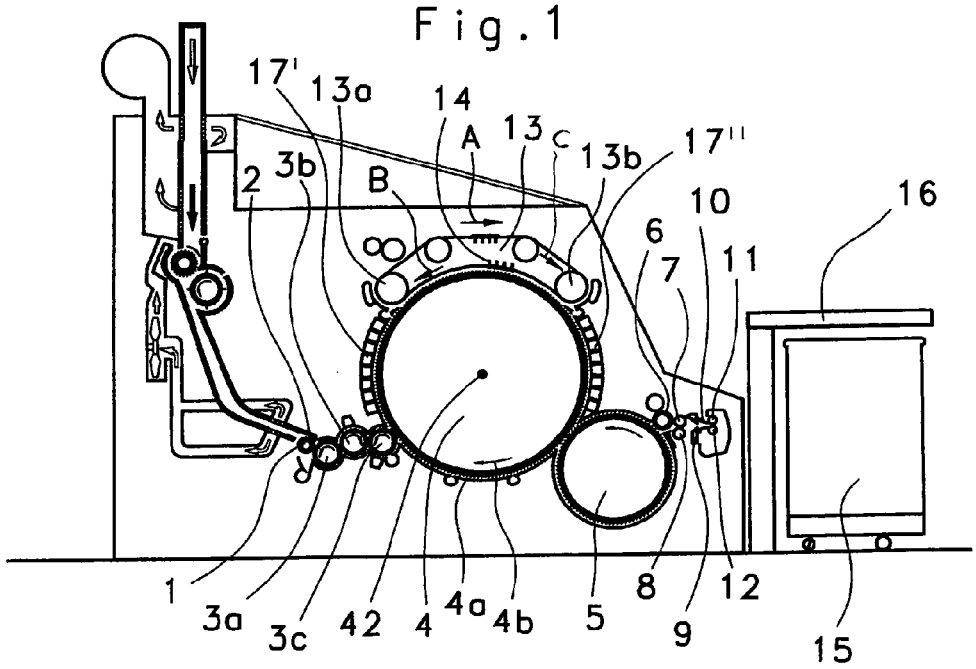
FIG. 1 is a diagrammatic side view of a carding machine with an apparatus according to the invention.

FIG. 1 shows a carding machine, for example a TC 03 (Trade Mark) carding machine made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 15 and can coiler 16. The directions of rotation of the rollers are indicated by curved arrows. Reference numeral 42 denotes the centre (axis) of the cylinder 4. Reference numeral 4*a* denotes the clothing and reference numeral 4*b* the direction of rotation of the cylinder 4. Reference letter B denotes the direction of rotation of the revolving card top 13 in the carding position and reference letter C denotes the return transport direction of the flats 14. Arranged between the licker-in 3*c* and the rear card top guide roller 13*a* are immobile machine or working elements, for example fixed carding elements 17', and arranged between the front card top guide roller 13*b* and the doffer 5 are immobile machine or working elements, for example immobile carding elements 17". The arrow A indicates the working direction.

Figure 2:
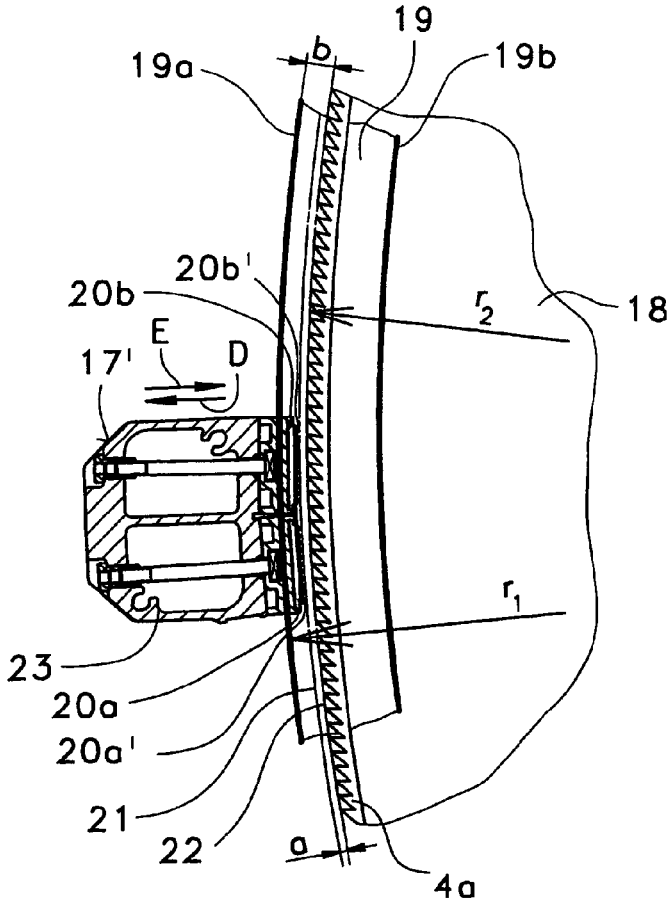
FIG. 2 shows a first embodiment of the invention, with a carding segment, a portion (in section) of a side panel with spacing between the clothing of the carding segment and the cylinder clothing.
Figure 2A:
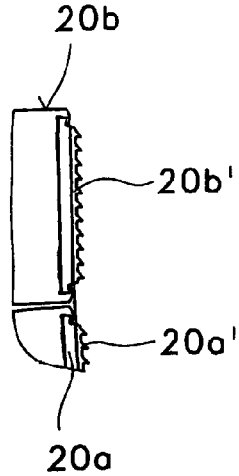
FIG. 2*a* shows the carding elements according to FIG. 2 in detail.

In an embodiment of the invention shown in FIG. 2, on each side of the carding machine there is attached laterally to the machine frame (not shown) an approximately semi-circular rigid side panel 18, at the outside of which there is cast concentrically, in the region of the periphery, an arc-shaped rigid support element 19 which has a convex outer face 19*a* as supporting face and an underside 19*b*.

Carding elements 17' have, at both of their ends, bearing faces that bear against the convex outer face 19*a* of the support element. Mounted at the lower face of the carding segment 17' are carding elements 20*a*, 20*b* with carding clothings 20*a'*, 20*b'*. Reference numeral 21 denotes the circle of tips of the clothings. The cylinder 4 has at its periphery a clothing 4*a*, for example saw-tooth clothing. Reference numeral 22 denotes the circle of tips of the cylinder clothing 4*a*. The spacing between the circle of tips 21 and the circle of tips 22 is indicated by reference letter a and is, for example, 0.20 mm. The spacing between the convex outer face 19*a* and the circle of tips 22 is indicated by the reference letter b. The radius of the convex outer face 19*a* is indicated by $r_1$ and the radius of the circle of tips 22 is indicated by $r_2$. The radii $r_1$, and $r_2$ intersect one another in the centre 42 (see FIG. 1) of the cylinder 4.

The carding segment 17' according to FIG. 2 consists of a carrier 23 and two carding elements 20*a*, 20*b*, which are arranged one behind the other in the direction of rotation (arrow 4*b*) of the cylinder 4, the clothings of the carding elements 20*a* and 20*b* and the clothing 4*a* of the cylinder 4 lying opposite to one another. A displacement device (for example, of the kind shown in FIG. 8) adjustable by means of fluid expansion and contraction brings about the displacement of the carrier 23 in radial direction in relation to the cylinder axis 42, as a result of which the carding segment 17' is shifted in the direction of the arrows D, E during displacement. The spacing a between the clothings 20'*a*, 20'*b* of the carding elements 20*a*, 20*b* and the cylinder clothing 4*a* is by that means accurately and simply adjustable.

Figure 3:
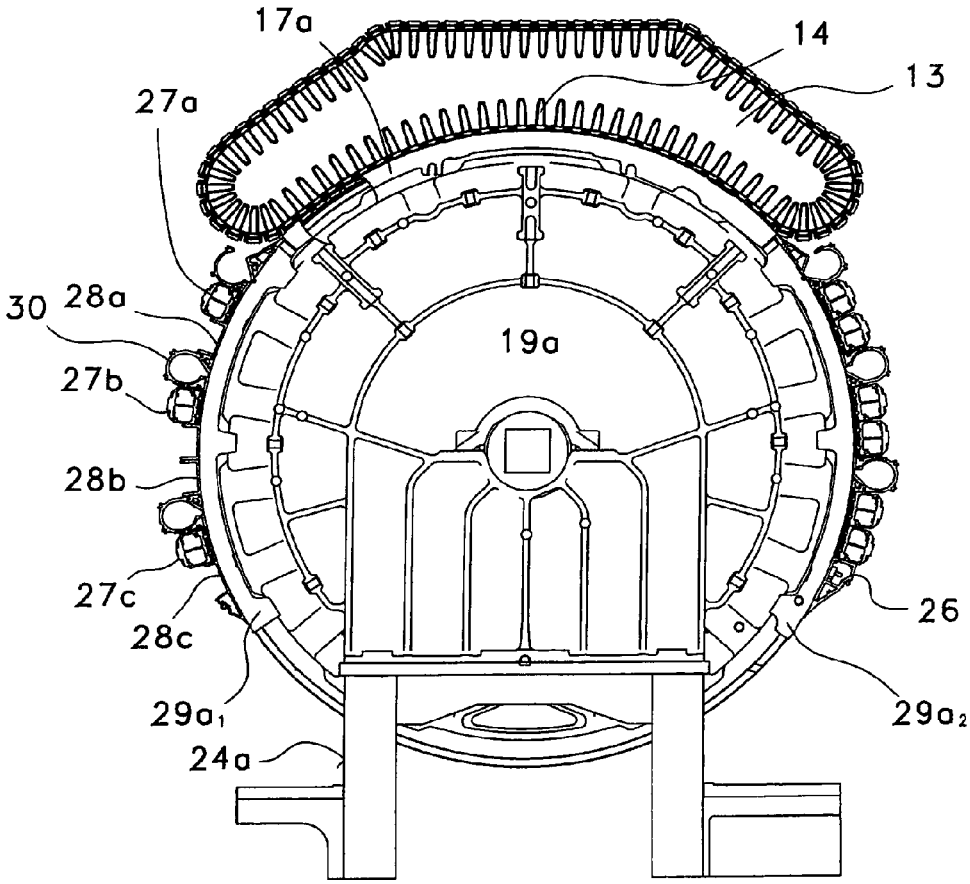
FIG. 3 is a diagrammatic side view of a further embodiment of the invention, showing a side panel with flexible bend, cylinder, extension bend, fixed carding elements and revolving card flats.

In the embodiment of FIG. 3, there are located between licker-in 3 and card top guide roller 13*a* three immobile fixed carding elements 27*a*, 27*b*, 27*c* and non-clothed cylinder casing elements 28*a*, 28*b*, 28*c*. The fixed carding elements 27 have a clothing which lies opposite to the cylinder clothing 4*a*. The fixed carding elements 27*a* to 27*c* are attached by way of screws and the cover elements 28*a* to 28*c* are attached by way of screws (not shown) to an extension bend 29*a* to 29*b* (in FIG. 3, only the extension bends $29a_1$, $29a_2$ on one side of the carding machine are shown), which in turn are fastened by way of screws to the card panels 19*a* and 19*b* (in FIG. 3, only 19*a* is shown) on each side of the carding machine. The flexible bends 17*a*, 17*b* (in FIG. 3 only 17*a* is shown) are fastened by way of screws to the side panels 19*a* and 19*b*, respectively. Reference numeral 24*a* denotes the machine frame.

Figure 4:
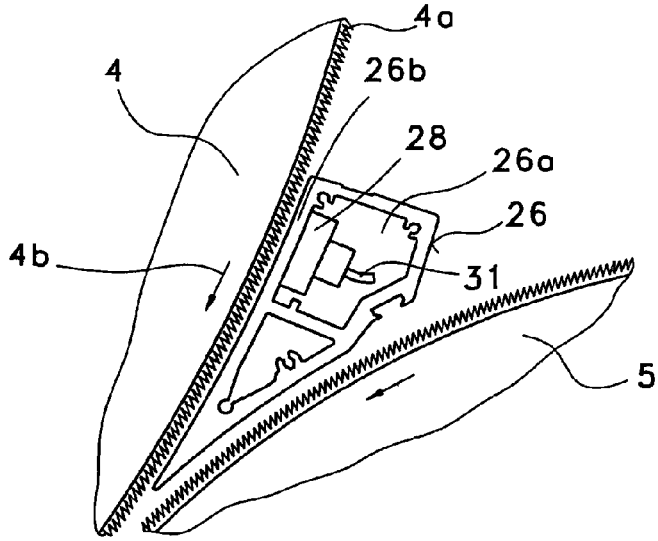
FIG. 4 shows a cover element in the angled gap between the cylinder and the doffer.

According to FIG. 4, there may be located in the angled gap between the cylinder 4 and the doffer 5 a cover element 26 (aluminium-extrusion element) in the internal space 26*a* of which there is a temperature sensor 28 for measuring the temperatures $T_{1E}$ and $T_1$ of the surface of the cylinder 4. The temperature sensor 28 is fastened to the wall face 26*b* lying opposite to the cylinder clothing 4*a*, at the side of the wall face 26*b* remote from the cylinder clothing 4*a*. Connected to the temperature sensor 28 is one end of a heat transfer hose 31, the other end of which is connected to a container part, filled with hydraulic oil, of a housing (see FIG. 5). The heat transfer hose 31 is filled, for example, with hydraulic oil and is thermally insulated (in a manner not shown).

Figure 5:
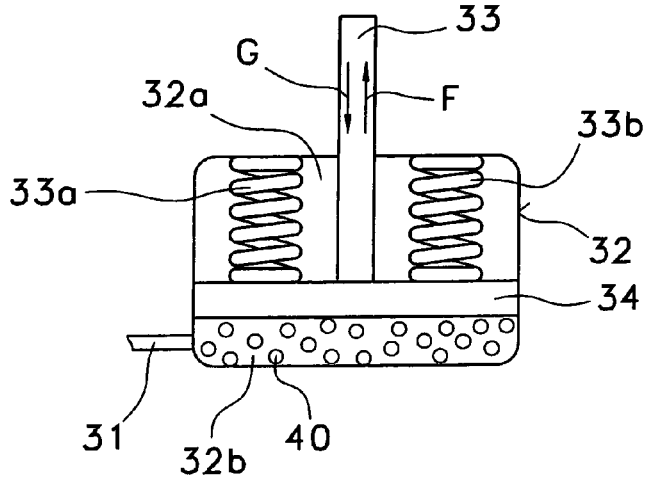
FIG. 5 shows a displacement device for use in an apparatus according to the invention.

FIG. 5 shows a displacement device in which a liquid having a high volume expansion coefficient is located in a sealed container 32. A piston rod 33 at a piston 34, which piston rod is spring-loaded, for example, by two compression springs 33*a*, 33*b*, serves to pressurise the liquid (excess pressure). When the liquid is heated, it expands. The projecting piston rod 33 moves out. The piston rod is joined to a working element (as, for example, in FIGS. 6 to 8), that element moves away from the cylinder 4. The energy required to heat the liquid can be drawn from the machine at the front, underneath, for example at a shaped cover element 26 as shown in FIG. 4. For example, by means of a foreign part (heat transfer part) which is connected by means of a hose 31 or tube to the displacement device and to the shaped cover element 26. The device is preferably mounted between the extension bend 29 and a working element. The piston rod 33 has, for example, a thread, so that a basic setting can be established between working element and cylinder 4. By the correct choice of liquid, piston face, spring pre-biasing and the volume of liquid, the apparatus is adaptable in terms of displacement force and displacement path. The housing 32 is divided into a housing part 32*a*, in which the compression springs 33*a*, 33*b* are located, and a housing part 32*b*, in which the liquid, for example, hydraulic oil, is located. The piston rod 33 and the pistons 34 are displaceable in the direction of arrows F and G on thermal expansion. Reference numeral 40 denotes the fluid diagrammatically.

A direct heat source (heating spiral) at or in the piston is also possible. The heating operation is controllable and regulatable.

Figure 6:
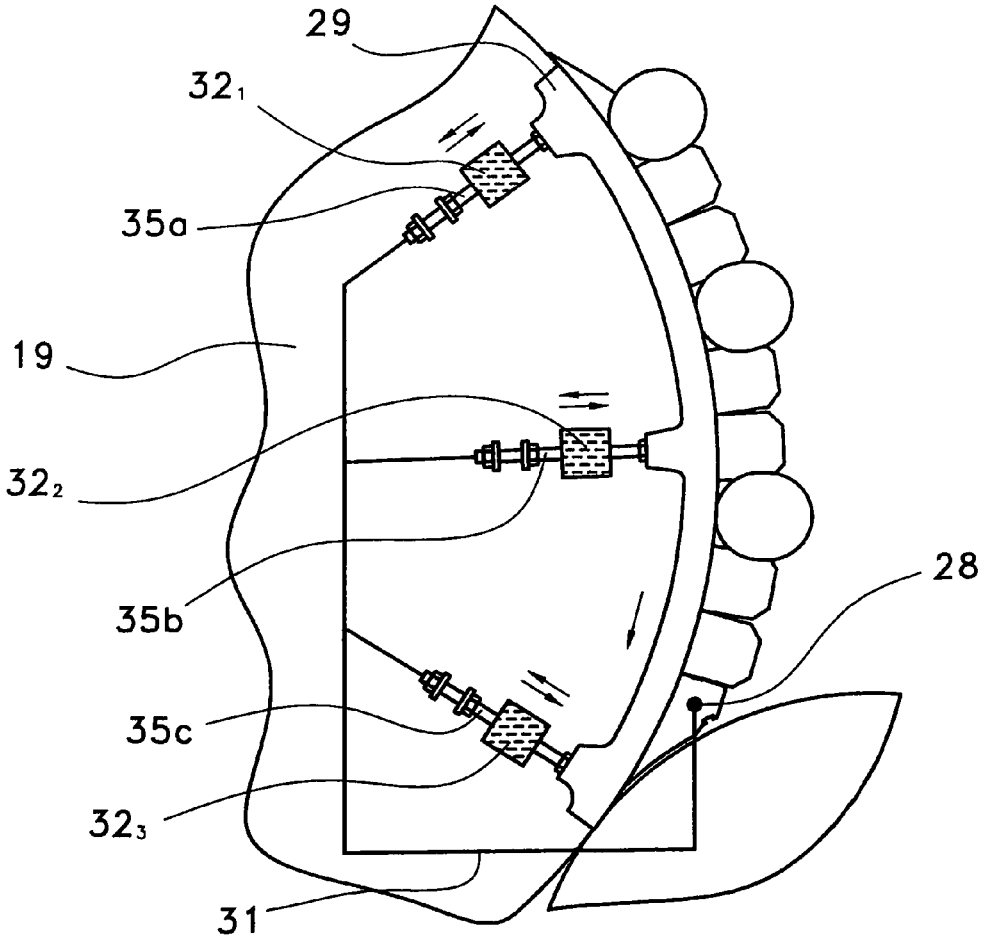
FIG. 6 shows an extension bend with fixed carding elements and a further embodiment of the invention, in which the extension bend with a plurality of working elements is shifted.

In the arrangement of FIG. 6, three devices $\mathbf{32}_1$, $\mathbf{32}_2$ and $\mathbf{32}_3$ of the invention are present, which are integrated into displacement spindles 35*a*, 35*b* and 35*c*, respectively, which displace the extension bend radially.

Figure 7:
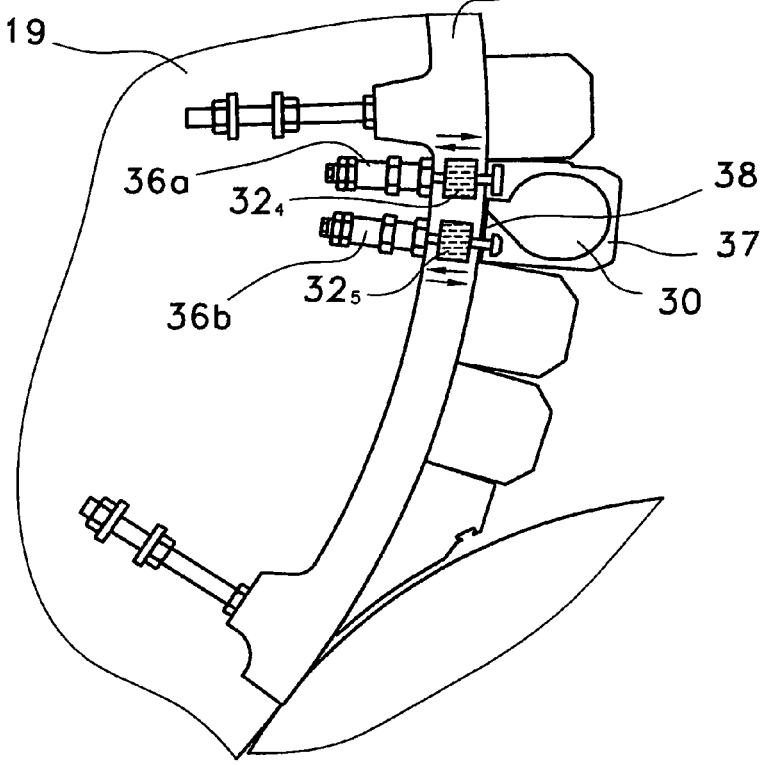
FIG. 7 is a side view of an extension bend similar in some respects to the extension bend of FIG. 5 incorporating another embodiment of the invention, in which a separator blade with suction hood is shifted.

In the arrangement of FIG. 7, two devices $\mathbf{32}_4$ and $\mathbf{32}_5$ of the invention are integrated into adjusting screws 36*a*, 36*b* for a working element 37 having a separator blade 38 and a suction hood 30.

Figure 8:
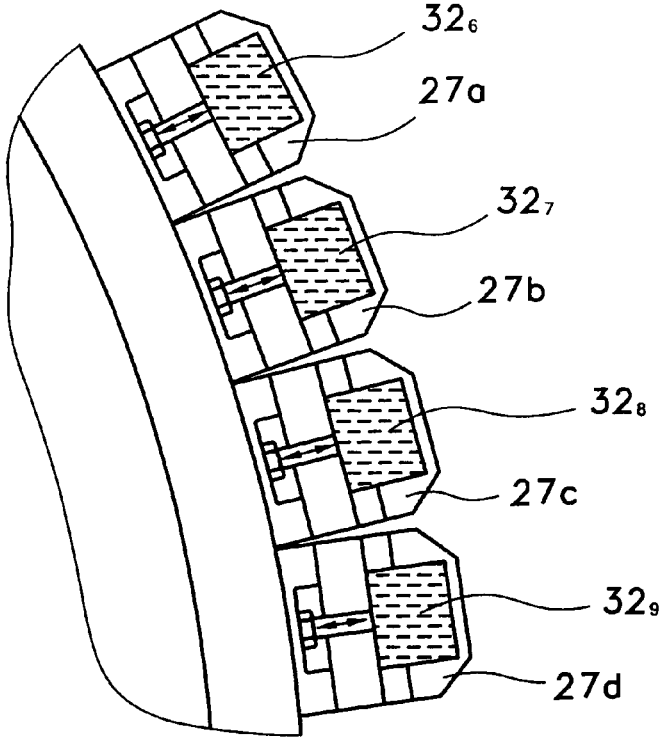
FIG. 8 shows a further embodiment of the invention in which individual working elements are shiftable.

In the arrangement of FIG. 8, four devices of the invention $\mathbf{32}_6$ to $\mathbf{32}_9$ are each integrated into fixed carding elements 27*a* to 27*d*, which render possible individual displacement.

An advantage of the invention is that use is made of a liquid medium that has a coefficient of expansion higher by, for example, a factor of 100 than that of solids. The apparatus requires a temperature change of only 20K to achieve a displacement of about 0.3 mm. That increase in temperature occurs at the components of the flat card. The required thermal energy can be used directly from the components (e.g. MTT shaped cover element at the front, underneath). Required for that purpose is a medium that in terms of expansion is correlated with the change in temperature in the carding machine or at components of the carding machine. The medium must be so selected that it compensates for the changes in the carding gap caused by temperature. With an assumed carding nip change of 0.1 mm per 10K increase in temperature, all that is required is a body 20 mm high filled with hydraulic oil. Hydraulic oil has a coefficient of expansion of $7\cdot10^{-4}$/K.

Example t:=10 K° Temperature difference $\gamma := h\cdot\gamma\cdot t$ h:=20 mm Filling height medium γ=0.140 mm Displacement path $\gamma := 7\cdot(10)^{-4}K$ Volume expansion coefficient Although the foregoing invention has been described in detail by way of illustration and example for purposes of understanding, it will be obvious that changes and modifications may be practised within the scope of the appended claims.

What is claimed is:

1. An apparatus at a carding machine having a cylinder with cylinder clothing, working elements, and displaceable holding elements which determine an adjustable spacing between the cylinder clothing and one or more of the working elements, further comprising:

a displacement device comprising at least one adjusting element for adjusting the position of one or more said displaceable holding elements to compensate for changes in the spacing during operation; and a fluid that is expansible by thermal energy supply and contractible by thermal energy discharge;

wherein said at least one adjusting element is displaceable by expansion and/or by contraction of the fluid.

2. An apparatus according to claim 1, in which the fluid is a substantially non-compressible liquid.

3. An apparatus according to claim 1, in which the fluid is a hydraulic oil.

4. An apparatus according to claim 1, in which the volume thermal expansion co-efficient of the fluid is high.

5. An apparatus according to claim 4, in which the volume thermal expansion co-efficient of the fluid is at least $$\alpha = 7\times10^{-5}\frac{1}{°K.}.$$

6. An apparatus according to claim 1, in which the co-efficient of thermal expansion of the fluid is selected such that the change in the carding gap is at least 0.05 mm per 10°K increase in temperature.

7. An apparatus according to claim 1, in which the adjusting element comprises a metal rod or a bar.

8. An apparatus according to claim 1, in which the displacement device comprises a housing and the adjusting element is attached by one end to the housing.

9. An apparatus according to claim 8, in which at least a portion of the adjusting element is arranged in the housing.

10. An apparatus according to claim 9, in which the adjusting element includes a piston and the fluid is present between the inner wall of the housing and at least one end face of the piston.

11. An apparatus according to claim 9, in which the fluid is located in a sealed interior space of the housing.

12. An apparatus according to claim 1, in which the adjusting element is biased.

13. An apparatus according to claim 1, in which a portion of the adjusting element is connected to a working element to be displaced.

14. An apparatus according to claim 1, in which the displacement is effected in radial direction in relation to the cylinder.

15. An apparatus according to claim 1, in which the displacement device is mounted between an extension bend and a working element.

16. An apparatus according to claim 1, in which the displacement device is mounted between an adjusting spindle and a working element or a flexible band.

17. An apparatus according to claim 1, in which the fluid is in communication with at least one component of the machine that becomes heated in use via a heat conduction means for receiving thermal energy from said at least one component.

18. An apparatus according to claim 1, in which the displacement device comprises a heating device which is arranged for heating the adjusting element.

19. An apparatus according to claim 1, in which the displacement device comprises a heating device which is arranged for heating the fluid or the region of the housing enclosing the fluid.

20. An apparatus according to claim 1, in which the adjusting element is positionally displaceable by expansion of the fluid.

21. An apparatus according to claim 20, in which the return of the adjusting element is effected by energy discharge from the fluid.

22. An apparatus according to claim 20, in which the return of the adjusting element is effected by a card flat setting system or a card flat measuring system.

23. An apparatus according to claim 1, comprising as working element(s), the position of which relative to the cylinder is adjustable by means of said fluid, one or more clothed carding elements, clothed rollers, and/or separator blades for trash.

24. An apparatus at a carding machine having a cylinder, working elements and displaceable holding elements, which determine the spacing between the cylinder clothing and the working elements, wherein a displacement device actuatable by thermal energy supply is provided for the working elements in order to compensate for changes in the spacing that arise during operation and in which at least one adjusting element cooperates with a fluid and the thermal energy is conveyable to the fluid, wherein the fluid is expansible by thermal energy supply and/or contractible by thermal energy discharge and the adjusting element is locally displaceable by expansion and/or contraction of the fluid.

25. A method of adjusting a working gap in a carding machine, comprising providing an adjusting element for positionally displacing a working element defining a limit of said working gap, providing a fluid that is thermally expansible and contractible, and utilising thermal expansion and/or contraction of said fluid for acting on said adjusting element for effecting positional displacement of said working element.

* * * * *